US005992698A

United States Patent [19]

Copeland et al.

[11] Patent Number: 5,992,698

[45] **Date of Patent: *Nov. 30, 1999**

[54] LIQUID SOAP DISPENSER

[75] Inventors: James L. Copeland, Apple Valley, Minn.; Jeff W. Peterson, Hudson, Wis.; Paul Anthony Pilosi, Minneapolis, Minn.

[73] Assignee: Ecolab Inc., St. Paul, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/512,227

[22] Filed: Aug. 7, 1995

[51] Int. Cl.[6] ..... B67D 5/06

[52] U.S. Cl. ..... 222/180; 222/325

[58] Field of Search ..... 222/180, 325, 222/183, 154, 505, 321.8, 181.2, 181.3

[56] References Cited

U.S. PATENT DOCUMENTS

| | | | |
|---|---|---|---|
| 3,032,081 | 5/1962 | La Cotta | 222/180 |
| 4,085,867 | 4/1978 | Heller | 222/181 |
| 4,164,306 | 8/1979 | Perrin | 222/325 |
| 4,166,553 | 9/1979 | Fraterrigo | 222/181 |
| 4,349,133 | 9/1982 | Christine | 222/183 |
| 4,461,445 | 7/1984 | Williamson et al. | 248/551 |
| 4,570,827 | 2/1986 | Roggenburg, Jr. et al. | 222/95 |
| 4,650,095 | 3/1987 | Tella et al. | 222/153 |
| 4,662,195 | 5/1987 | von Buelow et al. | 70/139 |
| 4,667,854 | 5/1987 | McDermott et al. | 222/101 |
| 4,673,109 | 6/1987 | Cassia | 222/153 |
| 4,741,461 | 5/1988 | Williamson et al. | 222/181 |
| 4,886,192 | 12/1989 | Cassia | 222/181 |
| 5,016,781 | 5/1991 | Ten Wolde | 222/325 |
| 5,165,577 | 11/1992 | Ophardt | 222/181 |
| 5,183,182 | 2/1993 | Comstock et al. | 222/129 |
| 5,209,377 | 5/1993 | Steiner et al. | 222/325 |
| 5,248,066 | 9/1993 | Olson et al. | 222/105 |
| 5,265,772 | 11/1993 | Bartasevich et al. | 222/214 |
| 5,613,625 | 3/1997 | Specht | 222/180 |
| 5,632,418 | 5/1997 | Brown | 222/180 |

OTHER PUBLICATIONS

"Antibacterial Clean and Smooth®" flyer, published by Ecolab Inc., St. Paul, Minnesota, in 1990.

*Primary Examiner*—Philippe Dergashani
*Attorney, Agent, or Firm*—Merchant & Gould P.C.

[57] ABSTRACT

Disclosed is a dispenser 10 for liquid soap having a cartridge 13 with a groove 32. A housing 12 encloses the cartridge 13 and mounting bracket 15. The dispenser's mounting bracket 15 has a rib 34 which corresponds with the groove 32 on the cartridge 13. Depression of a push plate 14 activates a pump 65 to expel liquid soap 41 from the cartridge 13.

15 Claims, 6 Drawing Sheets

FIG. 1
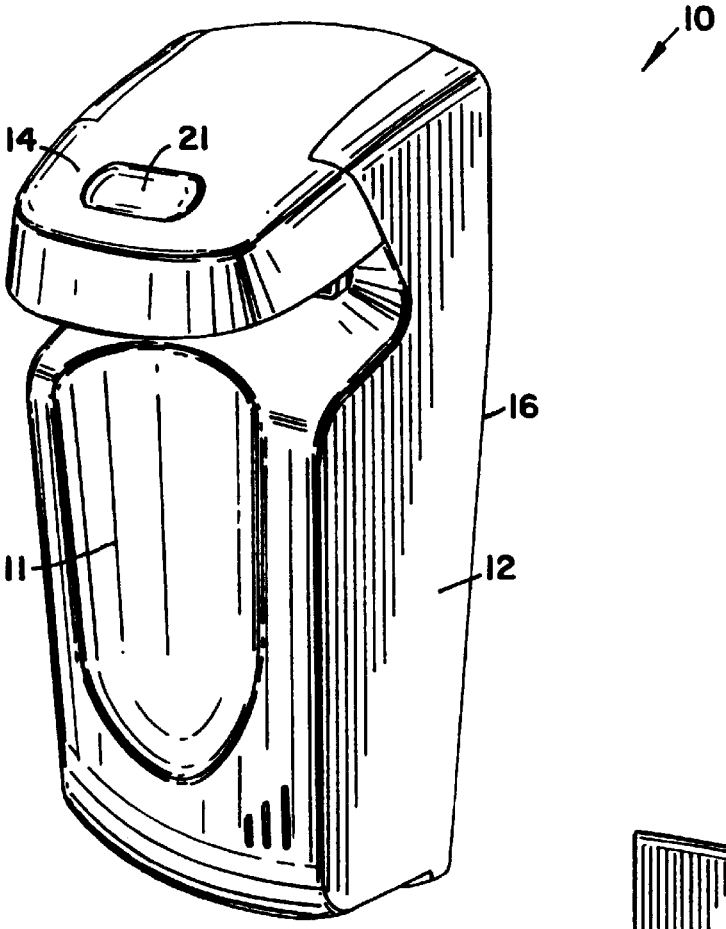
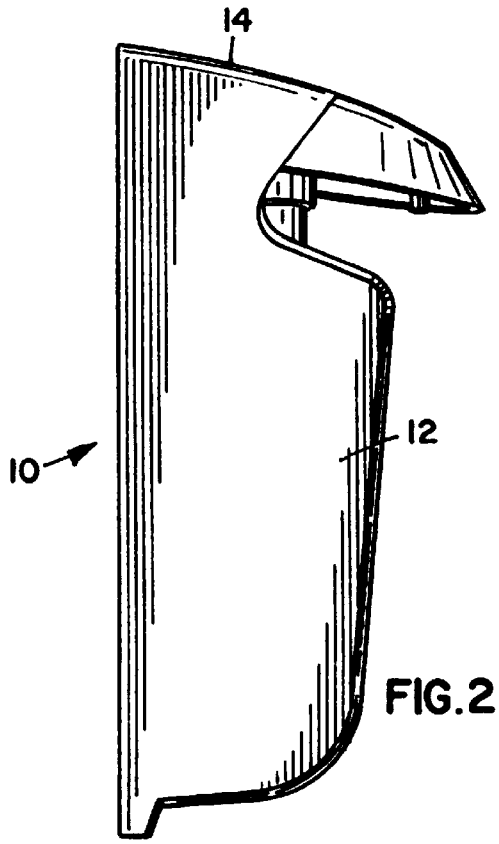
FIG. 2

LIQUID SOAP DISPENSER

FIELD OF THE INVENTION

The present invention relates to apparatus for dispensing liquid soap, normally in discrete small quantities. Such a dispensing apparatus is used, particularly for hygienic purposes, in public or institutional washrooms or wherever there are a relatively large number of different users.

BACKGROUND OF THE INVENTION

In restrooms, workshops, laboratories, hospitals and similar places, there are many individuals who require access to cleaning soap. Providing soap and detergent bars for multiple use poses a problem because some individuals dislike using a soap bar which had been used before by a person who may have left a wet, soggy soap bar. To obviate this problem to a degree, powdered soap dispensers have been provided. However, the dispensing of powders and pastes, if very viscous, is at an extremely slow rate, if at all. Also, powdered soap may cake in the hands and require vigorous rubbing with water before it becomes solubilized and loses its grittiness.

Liquid soaps therefore have certain advantages over soap bars and powdered soap, because the liquid soap is already partially emulsified in a diluent resulting in quick further dispersal. Liquid soap dispensers are well known and have been used and widely installed in lavatories in public places, such as restaurants, schools, hospitals, trains, etc.

Prior art devices for dispensing liquid soap usually have a reservoir that must be filled from a larger supply container. The filling operation tends to be time-consuming and messy. Such dispensers are usually mounted to a wall, making some parts difficult to service or replace. Also, it is often difficult to feed the product directly into the dispenser container by pouring the liquid from a big supply tank because the dispenser is so close to the wall.

Furthermore, prior dispensers have been of relatively complex construction, frequently using a large number of parts, the assembly of which entails substantial labor. For example, some dispensers employ a complex pressuring system to dispense the soap. These devices result in mechanical difficulties and are subject to undue wear and fairly rapid breakdown. Some difficulties may also arise when screws must be loosened for the replacement of parts, particularly the dispensing nozzle or cartridge pump, which may become rusted and/or encrusted with the soap.

Liquid soap dispensers which are installed in restrooms, washrooms and the like are subject to damage by vandals. It therefore becomes necessary for the dispensers to be repaired or replaced on a periodic basis. When several dispensers must be replaced periodically, it results in a significant expense and inconvenience.

In some situations, it is necessary to make sure that a certain type of product is dispensed from a certain dispensing apparatus. For example, a plurality of dispensers may be used in a hospital for dispensing different types of soap or lotion products, or a restaurant may employ a plurality of dispensers for several types of condiments. Another example is a situation in which a company has installed a relatively expensive and durable dispensing device which is intended for use with a high quality soap product, and the company wishes to prevent use of the dispenser with a lower quality soap product. With prior dispensers, there has been no mechanism to prevent the dispensing device from being filled with the improper type of product, when the dispensing device is meant to be dedicated to a certain type of product.

Some prior soap dispensers utilize a container or cartridge of liquid soap which is removably mounted on a dispensing apparatus so that it can be replaced by another cartridge when it is empty. However, the soap containers for some such dispensers are of the refillable type. This means that the spent containers must be collected, sterilized, refilled and sealed for reuse, which is a time-consuming and expensive operation. Because the container is refillable, the refill opening is accessible to users. This could result in contamination of the contents or refilling with soap from an unauthorized source.

In some dispensers, the container is readily removable from the dispenser by any user, so that the entire container could easily be replaced by a "bootleg" container. To avoid this problem, some dispensers are provided with closed, lockable cabinets for enclosing the refill cartridge or container, so as to prevent access by unauthorized persons. But this type of housing is relatively expensive. Furthermore, such prior dispensers have had a relatively complex construction, frequently using a large number of parts, the assembly of which entails substantial labor.

The prior art dispensers have exhibited one or more other disadvantages. Such disadvantages include the need for substantial pressure to expel the liquid, difficulty in replacing the liquid reservoir, liquid dripping, the opportunity for bacterial contamination, the potential for entrapping air, difficulty in varying the volume of delivered liquid, inability to substantially empty the liquid reservoir, and the like.

The present invention solves many of the problems associated with currently available dispensers.

SUMMARY OF THE INVENTION

The present invention is a wall-mounted dispenser for liquid soap and the like. The dispenser has a cartridge which contains the liquid material, and the cartridge has a groove on its rear face. The dispenser also has a mounting means which features a rib which is sized and configured to correspond with the groove on the cartridge. The dispenser's cover means substantially encloses the cartridge, and is hingedly interconnected to the mounting means. In the preferred embodiment, the dispenser's mounting bracket includes a movable latch member for fixing the cartridge into place. The rib and groove of the preferred dispenser are formed by adjustable members in the mold which fabricates the mounting plate and cartridge.

Another aspect of the invention is a method of manufacturing a liquid soap dispenser, comprising the steps of: forming a mounting bracket in a first mold, the mold having an adjustable insert for forming a rib on the mounting bracket; forming a cartridge in a second mold, the second mold having an adjustable channel for forming a groove in the cartridge; and assembling the cartridge and mounting bracket within a housing member.

An advantage of the dispenser is that the corresponding rib and groove of the mounting bracket and cartridge prevent the use of an improper product in the dispenser. This is because an improper or unauthorized cartridge will not fit into proper nesting position in the mounting bracket. The dispenser is designed such that the size and configuration of the ribs and grooves can be varied for different customers, and/or according to different types of soap (or other type of product) within the dispenser. For example, a hospital may need to provide an anti-microbial product for surgical areas, while a different type of soap is suitable for other areas of the hospital. Therefore, one area of the hospital would have a first type of dispenser design that would accommodate an anti-microbial product cartridge, whereas another area of the hospital would have a second type of dispenser design that would fit the cartridge of a different type of soap. A unique design for the dispenser's mold and the cartridge's mold facilitate the manufacture of dispensers and cartridges having different designs, in order to ensure that each dispenser is fitted with a cartridge containing the proper product.

Another advantage of the dispenser is that it is inexpensive to manufacture and durable. The dispenser can be made of inexpensive molded plastic parts with no hand machining and with no metal parts. The dispenser can be readily and easily assembled using molded parts and employing relatively unskilled labor. Therefore, the dispenser is relatively inexpensive, which is especially advantageous in the event that the dispenser is broken due to vandalism, tampering or other reasons.

Yet another advantage of the present invention is that the liquid dispenser can readily receive new soap cartridges. The dispenser does not require precise positioning of the cartridge so that the cartridge is in a position to dispense the liquid soap. Thus, the mounting and demounting of the cartridge is quickly and easily accomplished. The soap cartridges also eliminate the waste and spillage involved with many conventional dispensers.

Other features and advantages of the present invention will become apparent from the following description when taken in conjunction with the accompanying drawings. In the drawings, reference numerals indicate corresponding parts throughout the several views.

BRIEF DESCRIPTION OF THE DRAWINGS

FIG. 1 is a perspective view of the dispenser of the present invention;

FIG. 2 is a side elevational view of the dispenser of the present invention;

DETAILED DESCRIPTION OF THE PREFERRED EMBODIMENT

Figure 3:
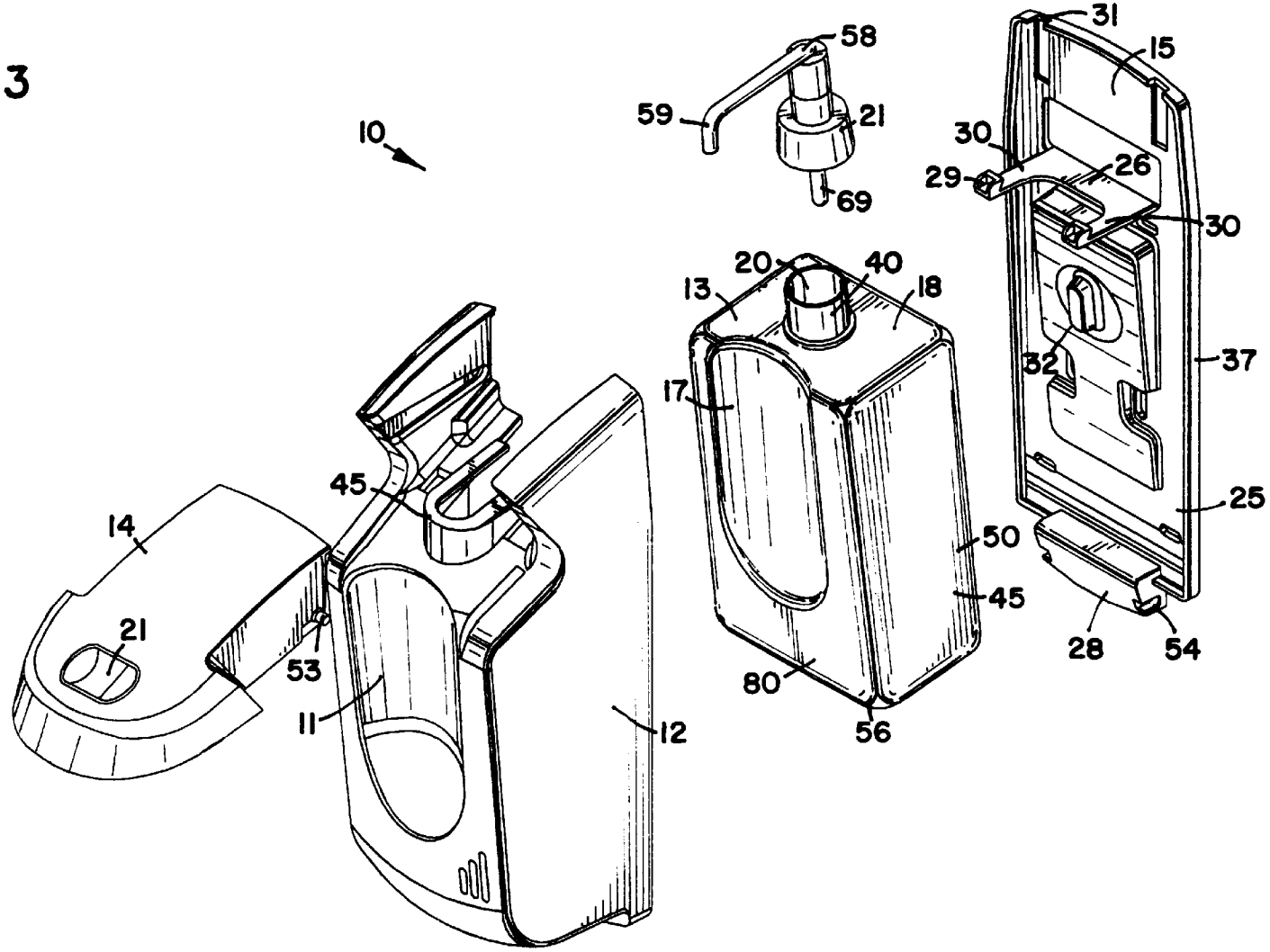
FIG. 3 is an exploded, perspective view of the dispenser and cartridge.

Referring to the drawings, the dispenser of the present invention is illustrated generally at 10 in FIGS. 1–3. The dispenser is intended for use with liquid soap and any other type of viscous liquid. The dispenser 10 is mounted to a vertical wall or other suitable surface. The dispenser 10 comprises a cover means or housing 12, a cartridge 13, a push plate 14, and a mounting means or bracket 15. In the preferred embodiment, each of the components 12, 14, 15 is made of a suitable plastic material and is formed by an injection molding process. A variety of plastic polymeric materials can be utilized in fabricating the housing 12 and bracket 15, such as polypropylene, high-impact polystyrene, acrylonitrile/butadiene/styrene terpolymer (ABS), etc. A preferred plastic material is ABS. Preferably, the cartridge is made from a blow molding process and is made from high-density polypropylene. The cartridge may be made from recycled plastic resins.

In the preferred embodiment, the surface of the housing 12 has a sloped or rounded shape which is aesthetically attractive and easy to clean. The cover or housing 12 is preferably a single, integral member. The front portion of the housing 12 has a curved, concave portion 11. The peripheral rim 16 of the cover 12 abuts against the wall or other surface upon which the dispenser 10 is mounted. The housing 12 and wall form a complete enclosure for the dispenser 10, and the housing 12 has a cutout 45 to accommodate the cartridge's discharge conduit 59.

The cartridge or refill bottle 13 contains the liquid soap or other product 41. The type of product contained within the cartridge 13 may include liquid soaps, shampoos, conditioners, household detergents, cleaners, polishes, moisturizing creams, condiments, etc. The body of the cartridge 13 can be of a variety of shapes, so long as the cartridge fits properly within the dispenser housing 12. With the illustrated design, the cartridge 13 has a top wall 18, a bottom wall 46, a pair of parallel side walls 45, a front wall 80, and a rear wall 50. The front surface 80 of the cartridge 13 has a concave portion 17 of the same size and configuration as the concave portion 11 of the cover 12.

Figure 5:
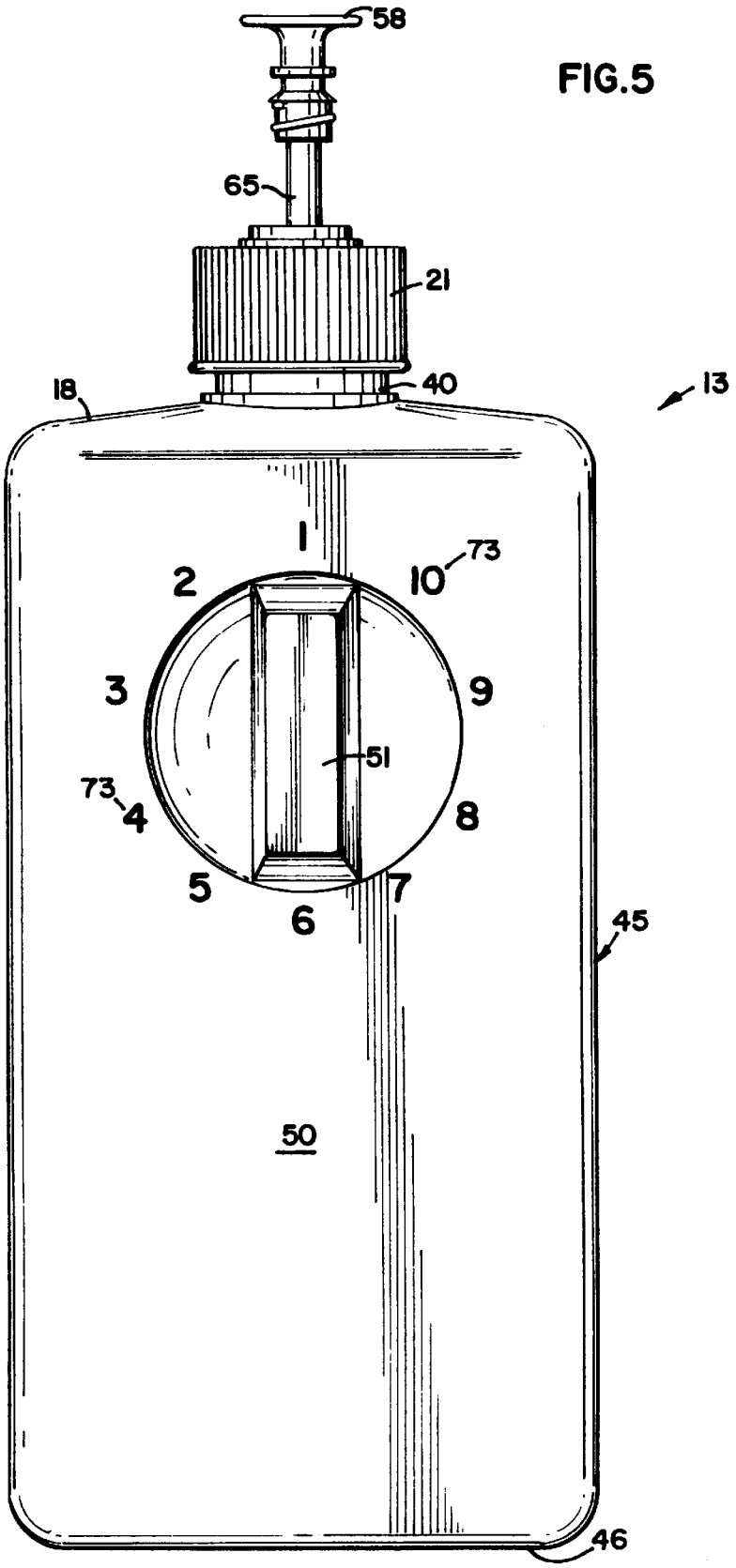
FIG. 5 is a rear elevational view of the cartridge.

The cartridge's rear wall 50 is flat except for one or more grooves 51 which are formed in the cartridge 13. FIG. 5 shows a slot or groove 51 formed in a portion of the rear wall of the container 13 or cartridge, the slot ending within the wall surface. The slot does not extend to the wall periphery. In the embodiment shown, the cartridge 13 has a single groove 51 which is rectangular, the longitudinal direction of which is vertical. The container 13 is relatively rigid and is preferably made of a transparent or translucent plastic material. The liquid material 41 within the cartridge 13 is preferably dyed. This allows the user to observe how full of product the cartridge 13 is. A view window (not shown) may be provided in the housing 12 to further facilitate monitoring of the amount of liquid material 41 in the cartridge 13. Preferably, the cartridge 13 has a volume of approximately one liter.

In the preferred embodiment, the lower part of the cartridge's front wall has a curved portion 56, rather than the front wall 80 and bottom wall 46 of the cartridge 13 meeting at a right angle. A dip tube 66 extends downwardly inside the cartridge 13 to withdraw the soap therefrom. The curved portion 56 of the cartridge 13 directs the soap to a portion of the cartridge 13 where it can be withdrawn by the dip tube 66.

In the preferred embodiment, the bottom wall 46 of the cartridge 13 slopes slightly downwardly toward the front. Most preferably, the angle of the slope is approximately seven degrees from horizontal. Furthermore, the central portion of the cartridge's bottom wall 46 is slightly depressed with respect to the remainder of the bottom wall 46. This forms a well where the liquid soap can collect and where the bottom of the dip tube 66 is positioned.

In the preferred embodiment, the upper end of the housing 12 is attached to a push plate 14. Preferably, the push plate 14 has a pair of pins 53 which fit within opposed apertures (not shown) on the housing 12. In order to expel the soap, the push plate 14 is suppressed by finger pressure on its upper surface. A stop member (not shown) on the housing prevents the push plate 14 from moving too far. A thumb depression 21 in the push plate 14 indicates to the user the optimal place for applying downward force on the push plate 14. An arrow on the front edge of the push bar indicates the point from with the product will be dispensed. In certain situations such as in the health care environment, it may be desirable to depress the push plate 14 with the forearm or elbow, so that the hands do not touch the dispenser 10.

The mounting bracket 15 has apertures 55 to receive screws or similar fastening means for mounting the bracket 15 on a wall. Rather than screws or fasteners, adhesive strips (not shown) could also be employed for attaching the mounting bracket 15 to the wall.

Figure 4:
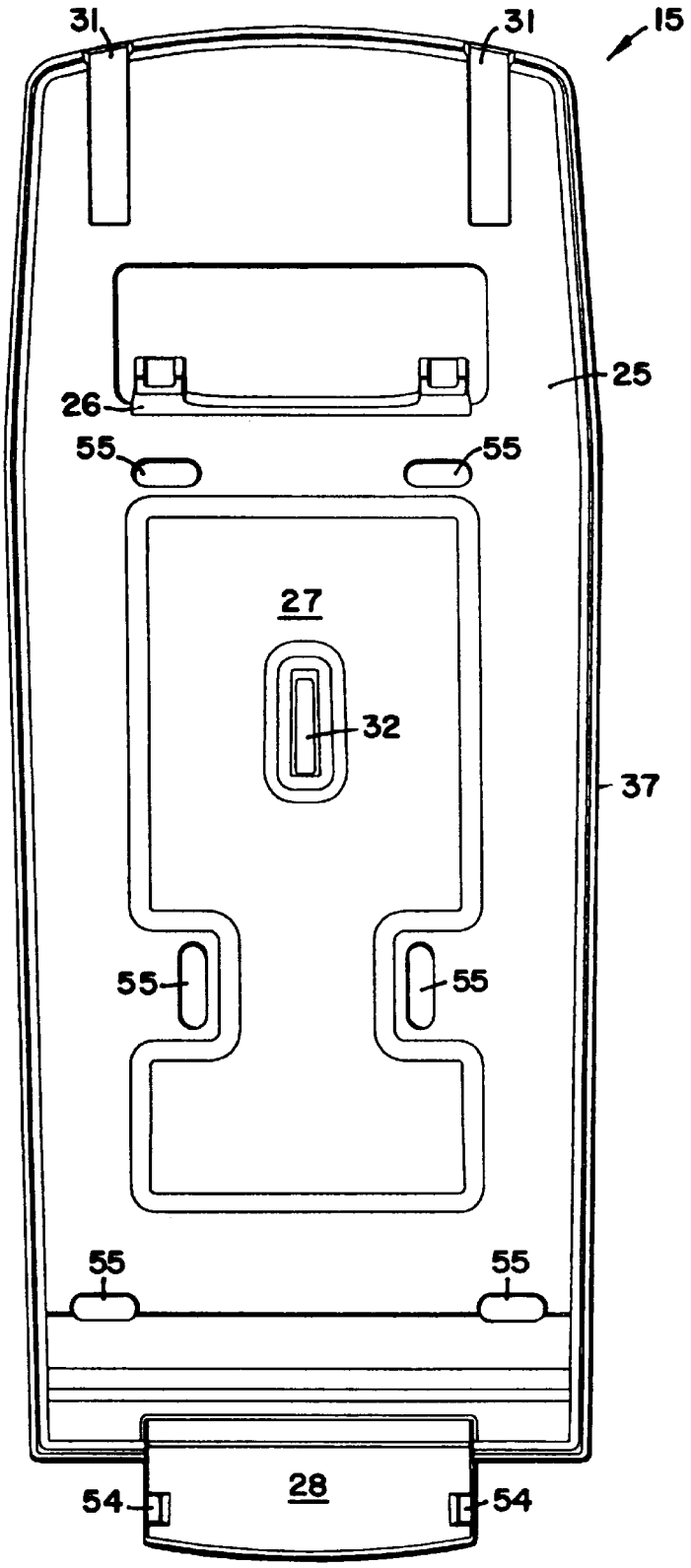
FIG. 4 is a front elevational view of the back plate of the present invention.

As shown in FIGS. 3 and 4, the mounting means 15 has a vertical plate 25, with a plurality of forwardly displaced members 26, 27, 28 which are formed integrally with the rear plate 25. The peripheral shape of the mounting bracket 15 corresponds to the shape of the housing 12, so that the housing 12, when positioned on the bracket 15, hides the bracket 15 from view. The mounting means 15 has a bottom surface or floor for supporting the cartridge 13.

A latch member 26 having a pair of flexible projections 30 is provided on the bracket 15. The movable projections 30 are at substantially a right angle to the wall, as shown in FIG. 3. The projections or arms 30 each terminate in a hook or detent 29. When the housing 12 is mounted on the bracket 15, the detents 29 engage with a pair of notches or recesses (not shown) formed within the housing 12. The inside of the mounting bracket 15 has a pair of ramps (not shown) which are in alignment with the arms 30. Due to the resilient nature of the arms 30, they are deflected downwardly against the ramps when the cartridge 13 and housing 12 are being slidably engaged. When the housing 12 is in position against the bracket 15, the detents 29 in the arms 30 spring upwardly into position to engage with the notches in the housing's ramps.

In the preferred embodiment, the upper portion of the mounting bracket's rim 37 has a pair of notches 31 which are sized and configured to accommodate a pair of downwardly extending members (not shown) within the housing 12. Additionally, the bracket 15 has a foot plate 28. The foot plate 28 has a pair of opposed apertures 54. The apertures 54 accommodate a pair of inwardly-extending pins (not shown) within the housing 12. In this manner, the housing 12 is hingedly interconnected to the mounting plate 15 by the foot plate 28. In order for the housing 12 to be removed from the stationary mounting plate 15, the user grasps the upper portion of the housing 12 and pulls the housing 12 in a direction away from the wall. When enough force is applied to the housing 12, the hooks 29 move out of position and allow the housing 12 to be moved away from the plate 15. The housing 12 then pivots downwardly, so as to expose the cartridge 13 and provide an access port for removing an empty cartridge 13 and replacing it with a full cartridge 13. When the cover 12 is pivoted back into place against the plate 15, the cover 12 completely encapsulates the mounting bracket 15 and cartridge 13. The foot plate 28 on the bracket 15 aids in positioning the cartridge 13 properly as the housing 12 is being closed. Thus the user need not precisely position or attach the cartridge 13 in the housing 12.

The mounting bracket 14 has a rib or fin 32. Only a single rib 32 is illustrated in the embodiment shown, but a plurality of ribs 32 could be provided. The rib or lug 32 protrudes from the front projection 27 on the bracket's surface. The rib 32 is sized and configured to engage with a groove or slot 51 on the rear surface 50 of the cartridge 13. The rib 32 is molded so as to be integral with the rest of the mounting bracket 15.

Multiple dispenser configurations can be achieved by varying the angle of the rib 32, and angle of the corresponding cartridge groove 51. Alternatively, the size, shape and position of those components could be varied. The interface between the rib of the bracket 15 and the groove 51 of the refill bottle 13 is accomplished by a unique design of the molds which are used to form the bracket 15 and the cartridge 13.

Figure 7:
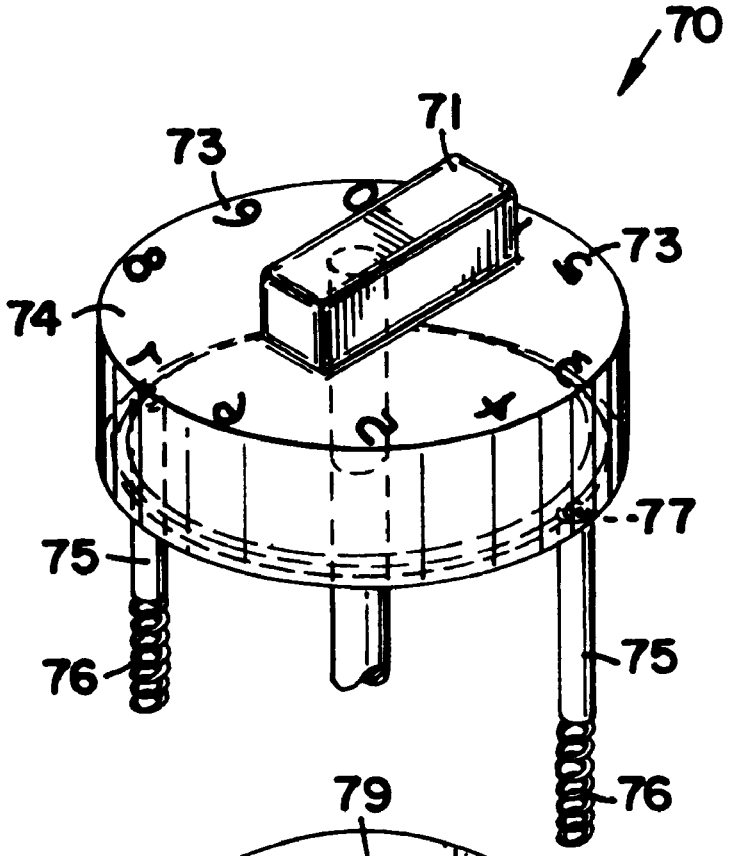
FIG. 7 is a perspective view of a tool assembly used in the manufacture of the dispenser.

Both the rib 32 on the bracket 15 and the groove 51 on the cartridge 13 can have a variety of positions, allowing for multiple keying combinations. FIG. 7 illustrates a perspective view of the tool assembly 70 which is used in the mold for the mounting bracket 15. The mold member 70 has a tool insert 71 which forms the rib 32 in the mounting bracket 15. The tool insert 71 is supported by a rotatable table 74. The table 74 rests upon a plurality of shoulder bolts 75 which are interconnected to spring pins 76. The tool insert 71 overlies a center rotating point 72, but one side of the tool insert 71 extends a greater distance from the center rotating point 72 than the other end of the tool insert 71. This offset feature improves the lockout interface between the bracket 15 and the container 13.

Figure 8:
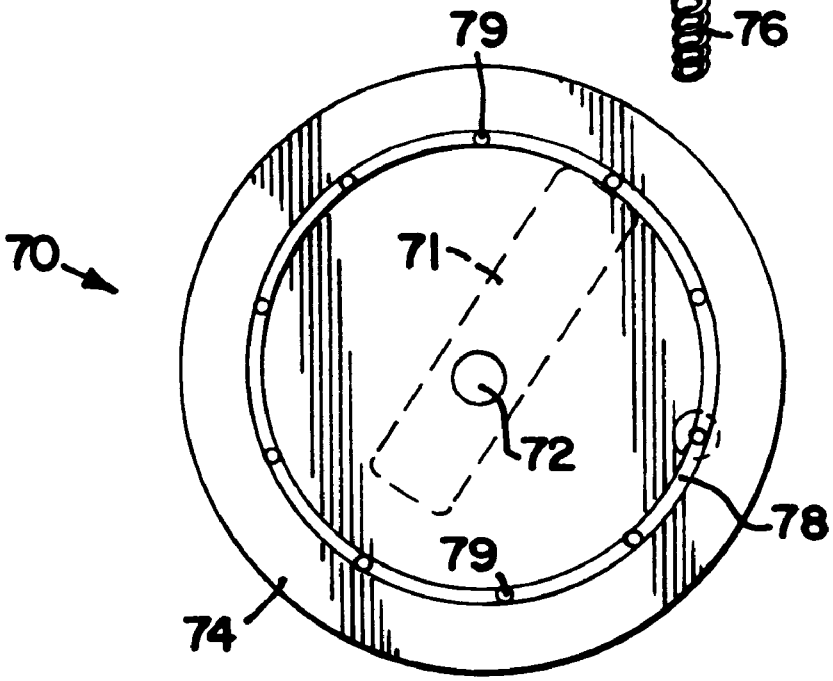
FIG. 8 is a bottom plan view of the tool assembly illustrated in FIG. 7.

The position of the tool insert 71 is adjustable. The possible locations of the tool insert 71 are identified using a series of numbers 73. This numbering system insures proper matching of the cartridge 13 and bracket 15 components. Although the mold pieces illustrated in FIGS. 7 and 8 are for the wall bracket 15, the design of the mold for the bottle 13 has a similar adjustment mechanism. As shown in FIG. 5, in one embodiment, the mold creates a circular region in the back surface of the bottle 13, and the slot 51 is formed within the circular region. In the preferred embodiment, the numbers are lightly embossed on the bracket 15 and bottle 13. With the numbering system illustrated, there are ten settings for the tool insert 71. Each setting of the tool insert 71 is spaced approximately 36 degrees apart, and the tool insert 71 can be rotated 360 degrees.

At the top of each shoulder bolt 75 is a pin 77. The underside of the table 74 has an annular track 78. The spring-loaded pin 77 rides in the race 78, and the race 78 has a plurality of recesses 79. In order to adjust the position of the tool member 71, the user simply depresses the table 74 and rotates the table 74 until the nubs 77 engage with the proper recesses 78. This operation can be done without removing any parts from the mold and without the replacement of any parts or tool inserts, which significantly reduces cost and time expenditures. Alternative adjustment mechanisms for the tool insert 71 could be devised. For example, the mold insert 71 could be adjustable by means of bolts which are loosened to allow rotation of the mold insert 71, with the bolts being tightened when the proper position of the mold insert is achieved.

For commercial reasons, if cartridges 13 containing only a certain type of liquid soap should be employed, then the cartridge 13 will have a particular configuration, and the mounting bracket 15 will have a corresponding configuration. These configurations could vary depending on the type of product being dispensed. Particular rib and groove configurations used in different settings and for different products prevent the use of unauthorized cartridges with the dispenser 10, because an unauthorized or "bootleg" cartridge 13 would not fit into proper nesting position in the mounting bracket 15.

The push plate 14 is squeezed to expel the liquid soap in the cartridge 13 directly into the user's hand. When the push plate 14 is depressed, the liquid soap is forced out by a pump assembly 65. The operation of the cartridge's pump mechanism 65 is illustrated in FIGS. 6A, 6B, 6C and 6D. The pump mechanism 65 has a cap 21 which fits on the neck 40 of the cartridge 13. The cap 21 is preferably bonded or otherwise securedly adhered to the cartridge 13 to prevent refilling of the cartridge 13 with an undesirable or improper product. The pump assembly 65 has a head 58 with a relatively flat upper surface. Preferably, the nozzle tip of the head 58 extends slightly downwardly and is attached to a discharge conduit or extender nozzle 59. The discharge conduit 59 is preferably a flexible tube which is friction fit on the outside of the head's nozzle. The flexible tube 59 extends beneath the push plate 14, and is substantially hidden from view by the lip of the push plate 14.

Figure 6D:
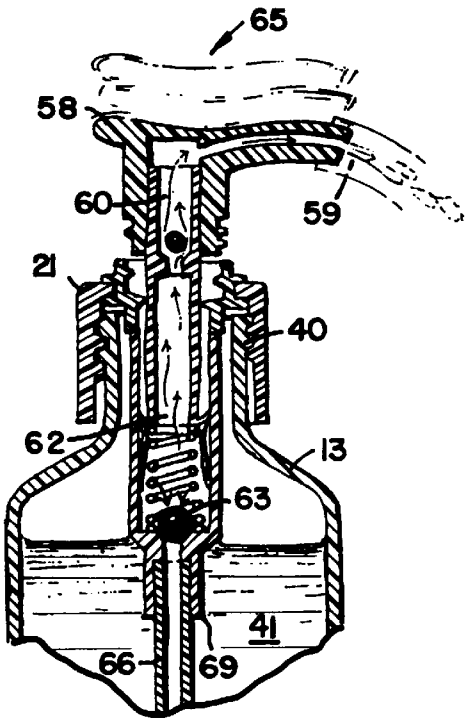
FIGS. 6A, 6B, 6C, and 6D are schematic views of the cartridge's pump.
Figure 6C:
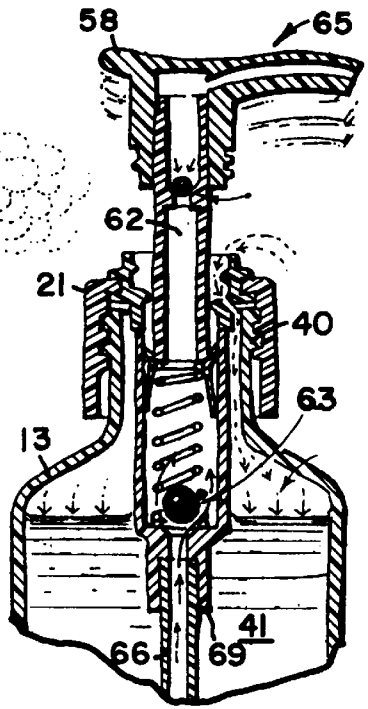
Figure 6B:
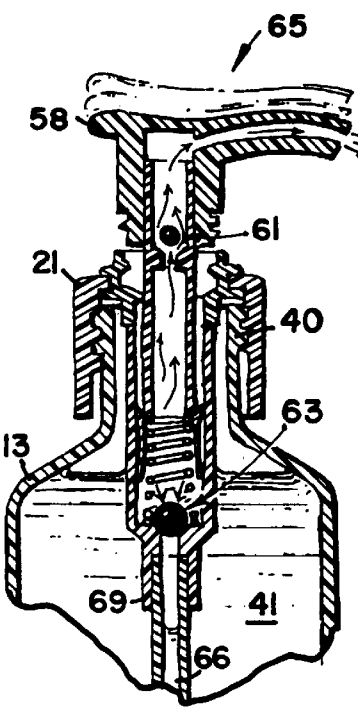
Figure 6A:
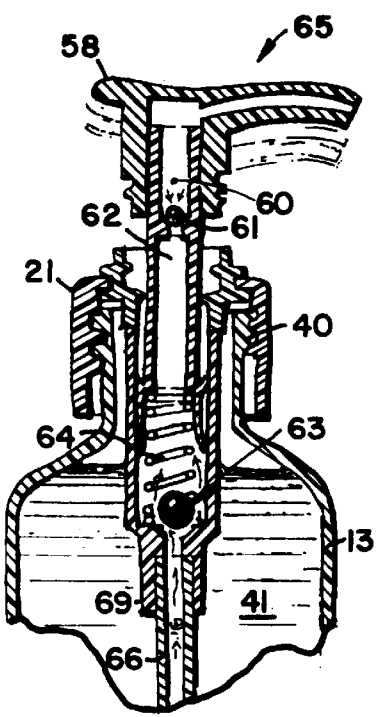

FIG. 6A illustrates the position of the pump mechanism 65 at the outset of the dispensing operation. In this position, the atmospheric pressure in the chamber 60 forces a ball valve 61 downwardly on its valve seat, and there is a vacuum in the piston chamber 62. A spherical valve 63 is displaced above its valve seat by means of a spring 64. In FIG. 6B, the initial downward stroke(s) on the head 58 displace the air in the pump 65, so that the ball valve 61 moves upwardly, and the spherical valve 63 moves downwardly. In FIG. 6C, the vacuum in chamber 62 pulls the soap product 41 into the pump 65, so that the pump 65 is now primed. Further downward compression strokes on the head 58 dispense the product 41 upwardly through the chambers 62 and 60, and then through the head 58 and discharge orifice 59. A dip tube 66 extends downwardly into the cartridge 13. The dip tube 66 is attached to the pump assembly 65 by an adapter 69. The dip tube 66 provides for complete evacuation of the cartridge 13.

In operation, the cartridge 13 is filled with liquid soap by the manufacturer or supplier of the cartridge 13. Preferably, the cartridge 13 is inexpensive in manufacture and is intended to be disposable. The cap 21 and pump assembly 65 are secured in place on the cartridge's neck 40. The housing 12 is pivoted away from the wall bracket 15, and the cartridge 13 is positioned upon the floor of the housing 12, so that the cartridge's cap 21 is in position within the housing's cutout 25, with the discharge conduit 59 extending beneath the push plate 14. In the preferred embodiment, there is a U-shaped guide (not shown) on the underside of the push bar 14 which maintains the extender tube 59 in the proper position. The housing 12 is then attached to the mounting bracket 15 by pivoting the housing 12 toward the plate 15 so that the two arms 30 engage with the notches within the housing 12.

In order to extract the liquid soap, it is necessary only to press the push plate 14. This operation causes the underside of the push plate 14 to contact the pump head 58 and thereby dispense a predetermined, controlled amount of liquid 41. To remove the cartridge 13 from the mounting bracket 15, the user grasps the upper portion of the housing 12 and pulls the housing 12 away from the bracket 15, so as to disengage the locking arms 30. This allows the cartridge 13 to be moved away from the bracket 14 without the use of tools.

It is to be understood that even though numerous characteristics and advantages of the invention have been set forth in the foregoing description, this disclosure is illustrative only. It is to be understood that the cartridge 13 could have an outwardly-projecting member which fits within a hollowed-out portion of the mounting means 15, rather than the rib and groove embodiment illustrated. Thus, the use of the terms rib, lug groove, slot insert, and channel are not meant to restrict themselves so as to designate only a female member or a male member. Changes may be made in detail, especially in matters of shape, size and arrangement of parts, within the principles of the invention, to the full extent indicated by the broad general meaning of the appended claims.

What is claimed is:

1. A dispenser for liquid materials, comprising:

a) a rigid cartridge for containing the materials and having a rear wall having a rear wall surface and a front wall, the cartridge including an elongated slot formed in a portion of the rear wall, the slot ending within the rear wall surface, the slot being non-circular in cross section and extending along the rear wall at one of a plurality of angular orientations with respect to vertical, the cartridge including a discharge opening having valve means;

b) a cover means which substantially encloses the cartridge; and c) a mounting means including a rib which is sized and configured to mate with the slot on the cartridge, the rib being rigidly fixed at the one of a plurality of angular orientations with respect to vertical, the cover means being hingedly connected to the mounting means, wherein the cartridge with the valve means are removable from the mounting means; whereby the angular orientations of the elongated rib and the elongated slot are configured to uniquely match the cartridge with the mounting;

wherein the rear wall of the cartridge includes markings about the slot to indicate the angular orientations of the slot, and wherein the mounting means includes markings about the rib to indicate the angular orientations of the rib; wherein the markings identify whether the angular orientation of the slot of the cartridge will match the angular orientation of the rib of the mounting means.

2. The dispenser of claim 1, wherein the portion of the rear wall of the cartridge includes a circular region therein, and the elongated slot is formed in the circular region.

3. The dispenser according to claim 1, wherein said mounting means is made of a plastic material and is molded in one unitary piece.

4. The dispenser according to claim 1, further comprising attachment means for attaching said cover means to said mounting means, said attachment means comprising a movable latch member on said mounting means which is sized and configured to releasably engage with said cover means.

5. The dispenser according to claim 4, wherein said mounting means is attached to a vertical wall.

6. The dispenser according to claim 3, wherein said mounting means includes two or more ribs.

7. The dispenser according to claim 3, wherein said cartridge includes two or more grooves.

8. The dispenser according to claim 3, wherein said angle of said groove and said rib depends upon a type of soap in said cartridge.

9. The dispenser according to claim 3, wherein said angle of said groove and said rib depends upon a type of user of said dispenser.

10. A dispenser for liquid soap, comprising:

a) a container for a first type of liquid soap, the container having a rear wall having a rear wall surface with an elongated slot formed in a portion of the rear wall, the slot ending within the rear wall surface and being non-circular in cross section and the slot extending along the rear wall at a first one of a plurality of predetermined angles with respect to vertical, the container including a discharge orifice;

b) a mounting bracket including a rigidly fixed elongated rib, the rib being sized and configured to fit within the slot, the rib being non-circular in cross section and extending at the first one of the plurality of predetermined angles, whereby the angles of the rib and the slot are configured to uniquely match the cartridge with the mounting bracket; and c) a housing for enclosing the container and mounting bracket;

wherein the rear wall of the cartridge includes markings about the slot to indicate the angle of the slot, and wherein the mounting bracket includes markings about the rib to indicate the angle of the rib; wherein the markings identify whether the angles of the slot of the cartridge will match the angle of the rib of the mounting means.

11. The dispenser according to claim 10, wherein said mounting bracket includes a movable latch member which is sized and configured to releasably engage with said housing.

12. The dispenser according to claim 10, wherein said groove and rib are at a second predetermined angle for a second type of liquid soap.

13. The dispenser according to claim 10, wherein said angle of said groove and said rib depends upon a type of soap in said cartridge.

14. The dispenser according to claim 10, wherein said angle of said groove and said rib depends upon a type of user of said dispenser.

15. A dispenser for liquid soap, comprising:

a) a container for a first type of liquid soap, the container having a rear wall having a rear wall surface with an elongated slot formed in a portion of the rear wall, wherein the portion of the rear wall of the cartridge includes a circular region therein, and the elongated slot is formed in the circular region, the slot ending within the rear wall surface and being non-circular in cross section and the slot extending along the rear wall at a first one of a plurality of predetermined angles with respect to vertical, the container including a discharge orifice;

b) a mounting bracket including a rigidly fixed elongated rib, the rib being sized and configured to fit within the slot, the rib being non-circular in cross section and extending at the first one of the plurality of predetermined angles, whereby the angles of the rib and the slot are configured to uniquely match the cartridge with the mounting bracket; and c) a housing for enclosing the container and mounting bracket.

* * * * *